US005899126A

United States Patent [19]

Fujiyama et al.

[11] Patent Number: 5,899,126

[45] Date of Patent: May 4, 1999

[54] SCREW TIGHTENER

[75] Inventors: Takeo Fujiyama; Takuya Yokote, both of Tokyo, Japan

[73] Assignee: The Max Co., Ltd., Tokyo, Japan

[21] Appl. No.: 08/752,434

[22] Filed: Nov. 14, 1996

Related U.S. Application Data

[63] Continuation of application No. 08/505,485, Jul. 21, 1995, abandoned.

[30] Foreign Application Priority Data

| | | | |
|---|---|---|---|
| Jul. 22, 1994 | [JP] | Japan | 6-192035 |
| Aug. 30, 1994 | [JP] | Japan | 6-228672 |
| Oct. 19, 1994 | [JP] | Japan | 6-279956 |

[51] Int. Cl.[6] ..... B25B 23/04

[52] U.S. Cl. ..... 81/434; 81/57.37

[58] Field of Search ..... 81/57.37, 434

[56] References Cited

U.S. PATENT DOCUMENTS

| | | | |
|---|---|---|---|
| 3,834,252 | 9/1974 | Abell et al. . | |
| 4,762,035 | 8/1988 | Fushiya et al. . | |
| 5,083,483 | 1/1992 | Takagi . | |
| 5,138,913 | 8/1992 | Chen | 81/434 |
| 5,167,174 | 12/1992 | Fujiyama et al. | 81/434 |
| 5,339,713 | 8/1994 | Hou | 81/424 |
| 5,402,695 | 4/1995 | Hornung | 81/434 |
| 5,473,965 | 12/1995 | Chen | 81/434 |

FOREIGN PATENT DOCUMENTS

| | | |
|---|---|---|
| 0 058 986 | 9/1982 | European Pat. Off. . |
| 0 532 819 | 3/1993 | European Pat. Off. . |
| 0 610 644 | 8/1994 | European Pat. Off. . |
| 24 27 713 | 6/1974 | Germany . |
| 2100880 | 4/1990 | Japan . |

*Primary Examiner*—James G. Smith
*Attorney, Agent, or Firm*—Morgan, Lewis & Bockius LLP

[57] ABSTRACT

A screw tightener using coupled screws comprises: a screw tightener body including a driver bit; a nose portion movable in the axial direction of the driver bit; a spring usually urging the nose portion to move forward from the screw tightener body; a feed wheel rotatably supported by the nose portion, wherein coupled screws supplied to the nose portion are fed in the direction of extension of the driver bit by interlocking the rotation of the feed wheel with the movement of the nose portion to be forced into the screw tightener body; retaining members for mutually retaining the screw tightener body and the nose portion when the indentation force is released after the nose portion is moved to be forced partway into the screw tightener body; and guide groove for preventing the retaining members from retaining when the nose portion is caused by the spring to undergo a reset movement with respect to the screw tightener body after the nose portion is moved to be forced into the screw tightener body by a predetermined movement.

5 Claims, 15 Drawing Sheets

SCREW TIGHTENER

This is a continuation of application Ser. No. 08/505,485, filed Jul. 21, 1995, which was abandoned upon the filing hereof.

BACKGROUND OF THE INVENTION

The present invention relates to a screw tightener using coupled screws, and more particularly a mechanism for feeding a screw and reversely extracting coupled screws.

There is a screw tightener of such a type that a feed wheel is supported by a nose portion which is relatively movable to the screw tightener body in order to feed coupled screws supplied to the nose portion by having the rotation of the feed wheel interlocked with the movement of the nose portion to be forced into the screw tightener body. In a case where a worker uses such a screw tightener to screw a face material on a prime material on the ceiling, he would hold one side of the face material with one hand and push up the other side thereof with the tip of the screw tightener held by the other hand. Due to the load of the face material at this time, the nose portion may be forced slightly into the screw tightener body and allow the feed wheel to rotate according to a minute sign (the so-called "clap sign"), so that the screw is pushed out. If it is then attempted to drive in the screw at a predetermined position by separating the screw tightener from the face material, the feed wheel will rotate again when the nose portion is pressed against the face material, thus causing a new screw to be fed. For this reason, the screw initially fed may be wasted and besides the nose portion will be clogged with the two screws introduced into a narrow space.

Moreover, the screw will not sufficiently be driven in and the screw head will also be protruded from the face material if the indentation load applied to the nose portion is released before the screw is sufficiently driven in; consequently, it is required to tighten the screw again. However, the forced-in movement of the nose portion allows the feed wheel to rotate and causes a new screw to be fed. The screw thus needs tightening again after what has newly been fed is removed and there arise the problem of making troublesome the work of removing the screw that has already been fed and the problem of wasting screws.

In a screw tightener of the sort mentioned above, there arises the necessity of reversely extracting coupled screws that have been mounted once therein in such a case that the coupled screw needs replacing in the course of the screw-tightening operation, and a mechanism for reversely extracting coupled screws has been employed accordingly. As disclosed in Japanese Unexamined Patent Publication No. 100880/1990, a conventional mechanism for reversely extracting coupled screws has been contrived so as to reversely extract a screw by lowering an operative lever in a screw tightener.

However, the operative lever is known to have damaged a sheet of paper covering the surface of, for example, a plasterboard as a material to be screwed down because the lever projecting from the surface of the screw tightener may strike against the material. Moreover, such an operative lever has been disadvantageous in that it is inferior in not only operability but also design as it is left projecting from the screw tightener, thus giving a unfavorable impression.

SUMMARY OF THE INVENTION

An object of the present invention made to solve the foregoing problems is to provide a mechanism for preventing two pieces of screws from being simultaneously fed by not allowing a nose portion to make a reset movement even when the indentation force applied to the nose portion that has been forced in once is released.

Another object of the present invention made to obviate the foregoing shortcomings is to provide a mechanism for reversely extracting coupled screws in a screw tightener for coupled screws, and more particularly such a mechanism as is excellent in operability, simple in structure, and so designed as not to come in contact with other members during the screw-driving operation.

In order to accomplish the objects, according to a first aspect of the present invention, there is provided a screw tightener using coupled screws comprising: a screw tightener body including a driver bit; a nose portion movable in the axial direction of the driver bit; a spring usually urging the nose portion to move forward from the screw tightener body; a feed wheel rotatably supported by the nose portion, wherein coupled screws supplied to the nose portion are fed in the direction of extension of the driver bit by interlocking the rotation of the feed wheel with the movement of the nose portion to be forced into the screw tightener body; retaining means for mutually retaining the screw tightener body and the nose portion when the indentation force is released after the nose portion is moved to be forced partway into the tightener body; and guide means for preventing the retaining means from retaining when the nose portion is caused by the spring to make a reset movement with respect to the screw tightener body after the nose portion is moved to be forced into the screw tightener body by a predetermined movement.

According to a second aspect, there is provided a screw tightener according to the first aspect, wherein the retaining position of the retaining means is a position to which the nose portion is moved and at which the nose portion is forced into the screw tightener body only by a feed of one screw.

According to a third aspect, there is provided a screw tightener according to the first aspect, wherein the retaining position of the retaining means is a position to which the nose portion is moved and at which the nose portion is forced into the screw tightener body only by a movement not exceeding what is equivalent to the predetermined drive-in depth of a screw.

According to a fourth aspect, there is provided a screw tightener using coupled screws comprising: a screw tightener body including a driver bit; a nose portion movable in the axial direction of the driver bit at the leading end of the screw tightener body fitted with the driver bit; a wheel rod fitted to the nose portion movably in the axial direction of the wheel rod; a coupled-screw feed wheel rotatably supported by the wheel rod; a feed wheel which is installed on one side of the coupled-screw feed wheel and coaxially superposed on the coupled-screw feed wheel only when the coupled-screw feed wheel rotates in the direction in which the coupled screws are fed in the state interlocked with the relative movement of the screw tightener and the nose portion; and a check pawl which is installed on the other side of the coupled-screw feed wheel and capable of retain one of the continuously-formed pawls on the outer peripheral face of the wheel rod only when the coupled-screw feed wheel rotates in the direction opposite to the direction in which the couples screws are fed, wherein the wheel rod whose one end is arranged so that it normally protrudes from a concave recess on the outer side of the nose portion to make the pawls and the check pawl face each other, is placed at a position where the feed wheel is allowed to mate with the coupled-screw feed wheel, and the pawl is shifted to a position where it will not correspond to the check pawl by pushing the one end of the wheel rod in the axial direction of the wheel rod, so that the feed wheel is moved to a position where the feed wheel and the coupled-screw feed wheel are not allowed to mate with each other.

In the screw tightener according to the first aspect, even if the nose portion is released from being pressed after the nose portion is moved to be forced into the screw tightener body halfway by pressing the nose portion against a material to be screwed down during the screw-tightening operation, the reset movement of the nose portion will be regulated since the retaining means mutually retain the nose portion and the screw tightener body. Therefore, the work of driving in the screw thus fed is carried out by pressing the nose portion against the material again.

When the nose portion makes the reset movement with respect to the screw tightener body after the screwtightening operation is terminated as it has been forced into the screw tightener body only by the predetermined movement, moreover, both the retaining means are guided by the guide means so that the retention is negated.

Since the nose portion makes no reset movement even when it is separated from the material after it is pressed thereagainst once to feed the screw, feeding two pieces of screws is effectively restrained.

In the screw tightener of the second aspect, even if the nose portion is released from being pressed after the nose portion is moved to be forced into the screw tightener body by pressing the nose portion against a material to be screwed down and moved up to a position at which one screw is fed during the screw-tightening operation, the reset movement of the nose portion will be regulated as the retaining means mutually retain the nose portion and the screw tightener body. Even though the nose portion is pressed against the material again, no screw will be fed newly and only the screw already fed will be driven in. Therefore, there arises no inconvenience in that two pieces of screws are fed according a minute sign.

In the screw tightener of the third aspect, even if the indentation force is released after the nose portion is moved to be forced into the screw tightener body only by a movement not exceeding what is equivalent to the predetermined drive-in depth of a screw, the retaining means mutually retain the nose portion and the screw tightener body so as to regulate the reset movement of the nose portion. Therefore, the screw can be tightened again when the head of the screw is protruded from the material.

In the screw tightener of the fourth aspect, when the coupled screws that have been mounted once are reversely extracted, the pawl of the wheel rod is moved to the position. where it will not correspond to the check pawl by pushing one end of the wheel rod protruded from the concave recess on the outer side of the nose portion in the axial direction, and the feed wheel is simultaneously moved to the position where it does not mate with the coupled-screw feed wheel. Consequently, the coupled-screw feed wheel is set free from being rotated in the direction opposite to the feeding direction. While the coupled-screw feed wheel is reversely rotated, the coupled screw can be extracted in the direction opposite to the direction in which it has been fed.

When the wheel rod is moved to the original position, the pawl faces the check pawl again and returns to the position where the feed wheel mates with the coupled-screw feed wheel.

DETAILED DESCRIPTION OF THE PREFERRED EMBODIMENTS

A screw tightener which includes a mechanism for preventing two pieces of screws from being fed will be described.

Figure 7A:
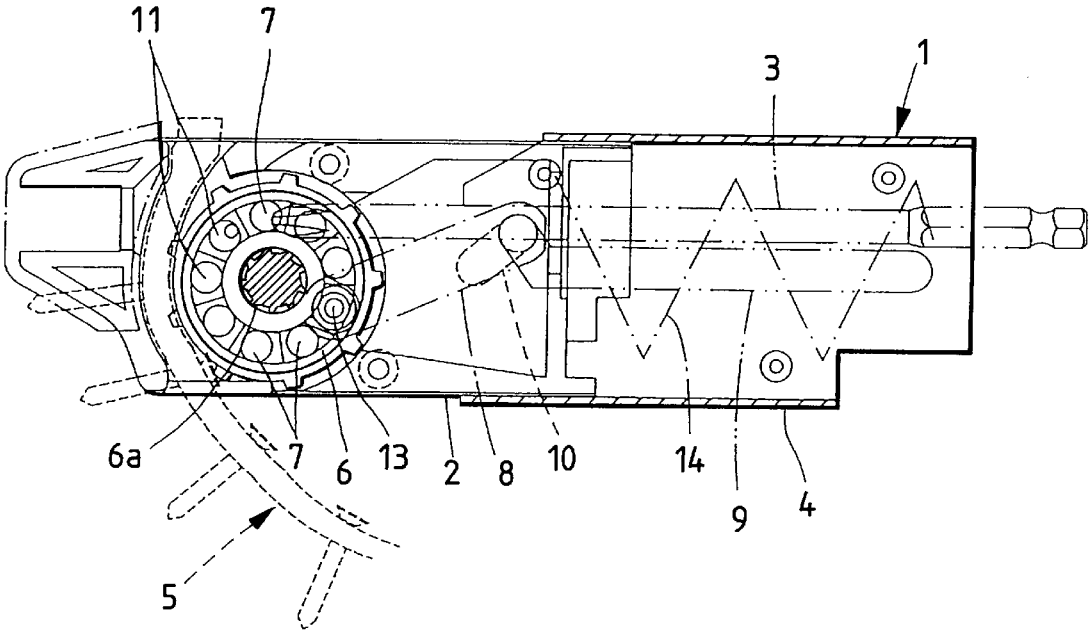
FIGS. 7(*a*) and 7(*b*) show a diagram illustrating a screw feeding mechanism in the screw tightener above.
Figure 7B:
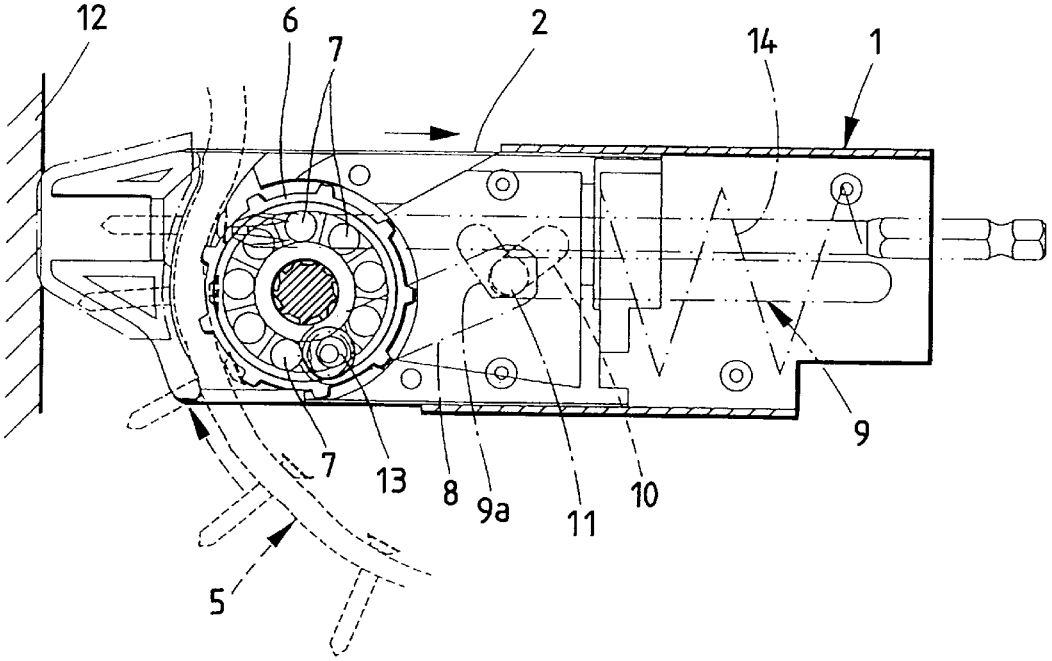

FIG. 7(*a*) shows the front portion of the screw tightener, wherein reference numeral 1 denotes a screw tightener body; and 2, a nose portion. The screw tightener body 1 is fitted with a driver bit 3 and a mechanism (not shown) for driving the driver bit 3 to rotate, and the nose portion 2 is held by a nose holder 4 of the screw tightener body 1 so that it is movable in the axial direction of the driver bit 3. A feed wheel 6 for feeding coupled screws 5 upward from below is rotatably mounted on a rotary shaft 6*a* supported by both left and right sides of the nose portion 2. The feed wheel 6 is set unidirectionally rotatable.

There are formed feed holes 7 at equal intervals in the circumferential direction of the feed wheel 6. Further, a feed plate 8 is placed between the screw tightener body 1 and the nose portion 2. A roller 11 engaging with roller guide grooves 9, 10 formed in the screw tightener body 1 and the nose portion 2 is provided at one end of the feed plate 8, whereas a mating pin 13 which fits into and comes off the feed hole 7 is provided at the other end thereof.

When the front end of the nose portion 2 is pressed against a material 12 to be screwed down by pushing the screw tightener body 1 forward during the screw-tightening operation, the nose portion 2 relatively moves back as shown in FIG. 7(*b*); in unison with the relative movement, the roller 11 at one end of the feed plate 8 is moved while guided by the roller guide grooves 9, 10 of the nose portion 2 and the screw tightener body 1. As the movement of the roller 11 in the moving direction of the nose portion 2 is smaller than that of the nose portion 2, the mating pin 13 at the other end of the feed plate 8 presses the feed wheel 6 opposite to the direction in which the nose portion 2 moves while the mating pin 13 is kept fitting into the feed hole 7 of the feed wheel 6. Therefore, the feed wheel 6 turns in the feeding direction by an angle of rotation required to feed one of the coupled screws 5 in the direction of extension of the driver bit 3. Further, the driver bit 3 engages with the screw thus fed as the screw tightener body 1 is pushed forward and while the screw is kept rotating, it is driven into the material 12.

When the screw tightener is separated from the screw after the screw-driving operation, a spring 14 causes the nose portion 2 to move to the original reset position. Then the roller 11 of the feed plate 8 is moved while finally guided by the tilted short groove 9*a* of the roller guide groove 9 and the roller guide groove 9 of the nose portion 2. Since the movement of the roller 11 in the moving direction of the nose portion 2 is smaller than that of the nose portion 2, however, the mating pin 13 of the feed plate 8 moves back against the spring force and comes off the feed hole 7 and then moves on to the following feed hole 7. Further, the mating pin 13 is urged by the spring to fit into the feed hole 7, so that the next feeding operation is prepared. In this case, the feed wheel 6 is restrained by a reverse rotation preventive mechanism (not shown) from reversely rotating.

As set forth above, the movement of the nose portion 2 to be forced into the screw tightener body 1 is interlocked with the feeding of the coupled screw 5. The screw tightener body 1 and the nose portion 2 are each provided with retaining means for mutually retaining them when the indentation force is released after the nose portion is moved to be forced into the screw tightener body halfway, and guide means for negating the retention effected by both the retaining means when the nose portion is caused by the spring to make a reset movement with respect to the screw tightener body after the nose portion is moved to be forced into the screw tightener body only by a predetermined movement.

Figure 1A:
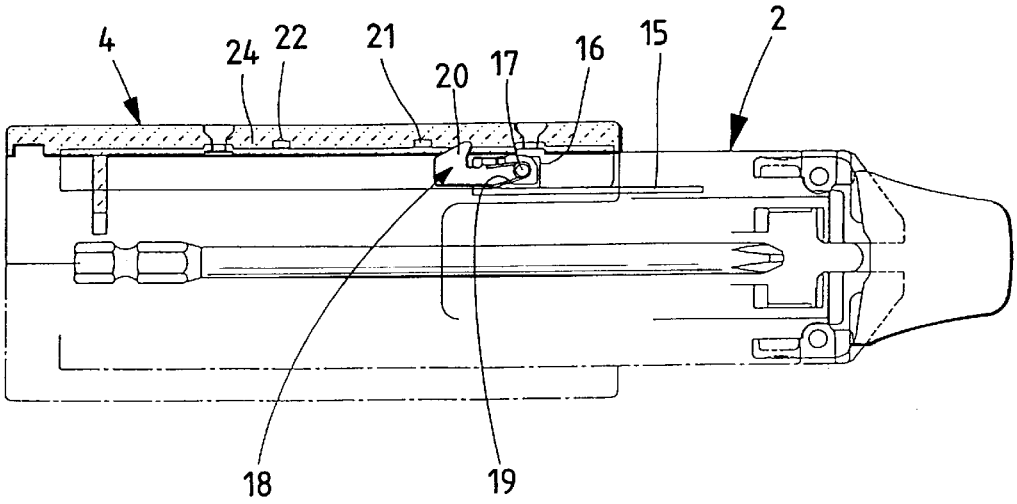
FIGS. 1(*a*) and 1(*b*) is a top and a side view of the principal part of a mechanism for preventing two pieces of screws from being simultaneously fed to a screw tightener according to the present invention.
Figure 1B:
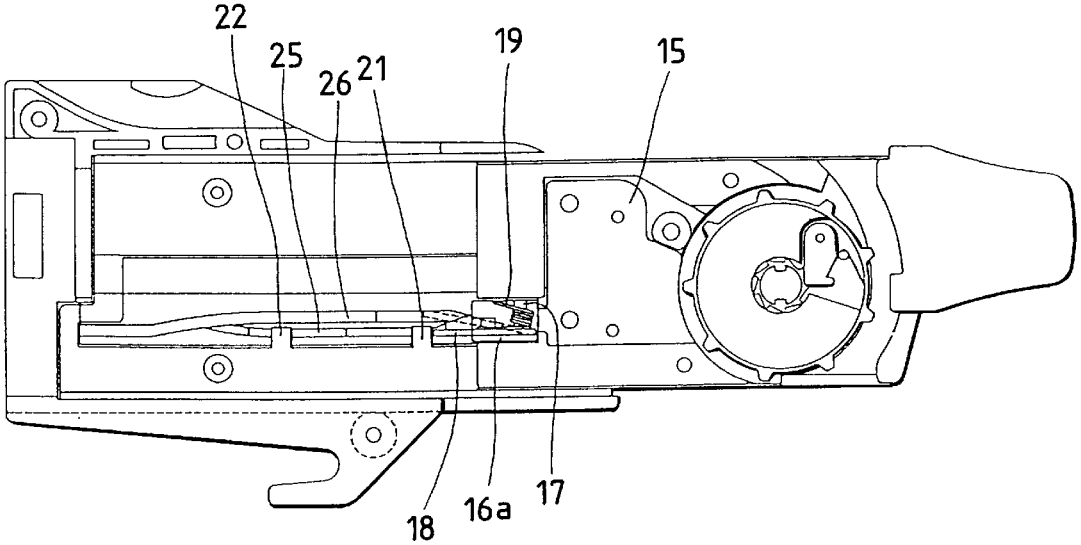

More specifically, as shown in FIGS. 1(*a*) to 3, a support shaft 17 is projected from the sidewall 16*a* of the L-shaped fitting 16 of a feed plate guide 15 secured to the side of the nose portion 2, and a retaining pawl 18 is supported by the support shaft 17 rotatably and laterally. The retaining pawl 18 is urged by a spring 19 fitted to the support shaft 17 so that a front-end pawl 20 is revolved outwardly. In this case, the retaining pawl 18 is formed with a thin plate material and usually urged by the spring 19 so as to abut against the sidewall 16*a* of the L-shaped fitting 16.

On the other hand, a first and a second retaining member 21, 22 are formed on the moving locus of the pawl 20 of the retaining pawl 18 of the nose portion 2. The first retaining member 21 is provided at a position where it can mate with the retaining pawl 18 when the indentation force is released after the nose portion 2 is moved to be forced into the screw tightener body 1 by a feed necessary for screw feeding. The second retaining member 22 is provided at a position where it can mate with the retaining pawl 18 when the indentation force is released after the nose portion 2 is moved to be forced into the screw tightener body 1 by a movement not exceeding what is equivalent to the predetermined drive-in depth of a screw.

On the sidewall 24 of the nose holder 4 of the screw tightener body 1 are a first and a second guide groove 25, 26. The first guide groove 25 is used to guide the retaining pawl 18 so that it can mate with the retaining members 21, 22 when the nose portion 2 is moved to be forced into the screw tightener body 1 against the spring 14. Whereas the second guide groove 26 is used to guide the retaining pawl 18 so that the retaining pawl 18 is evacuated from the retaining members 21, 22 when the nose portion 2 is moved by the spring 14 from the screw tightener body 1 to be reset after the nose portion 2 is forced into the screw tightener body 1 by a predetermined movement. The second guide groove 26 is formed in such a way as not to pass on the first and second retaining members 21, 22. The first and second guide grooves 25, 26 are continuous in the form of a loop. Moreover, the bottoms of the first and second guide grooves 26 are tilted and formed with risings for guiding the retaining pawl 18 (directly retaining pawl 20). The first and second risings 27, 28 are used to guide the retaining pawl 18 so as to make the first and second retaining members 21, 22 readily retain the pawl. The third rising 29 is used to prevent the retaining pawl 18 that has crossed the third rising from moving toward the first guide groove 25 when it moves reversely, whereas the fourth rising 30 in the second guide groove 25, 26 is used to prevent the retaining pawl 18 that has crossed the fourth rising from moving toward the second guide groove 26 when it moves reversely.

Figure 2:
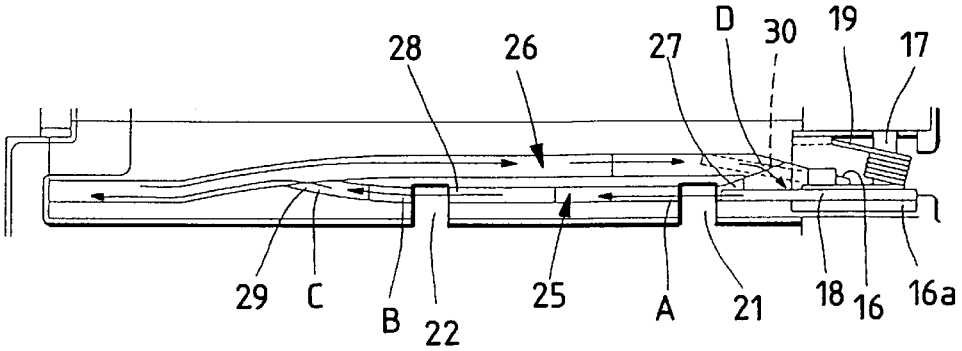
FIG. 2 is an enlarged view of the principal part of the guide means of FIG. 1(*b*)

With the arrangement stated above, the retaining pawl 18 also slides along the first guide groove 25, crosses the third rising 29 and then moves into the second guide groove 26 as shown in FIG. 2 when the nose portion 2 is forced into the screw tightener body 1 by pressing the nose portion 2 against the material during the screw-tightening operation as mentioned above. Further, the nose portion 2 is moved by the spring to be reset after the nose portion 2 is separated from the screw on the termination screw-tightening operation, and the retaining pawl also returns to the original position. When the nose portion 2 returns to the initial position, the retaining pawl 18 also crosses the fourth rising 30 and returns to the first guide groove 25 again.

Figure 3:
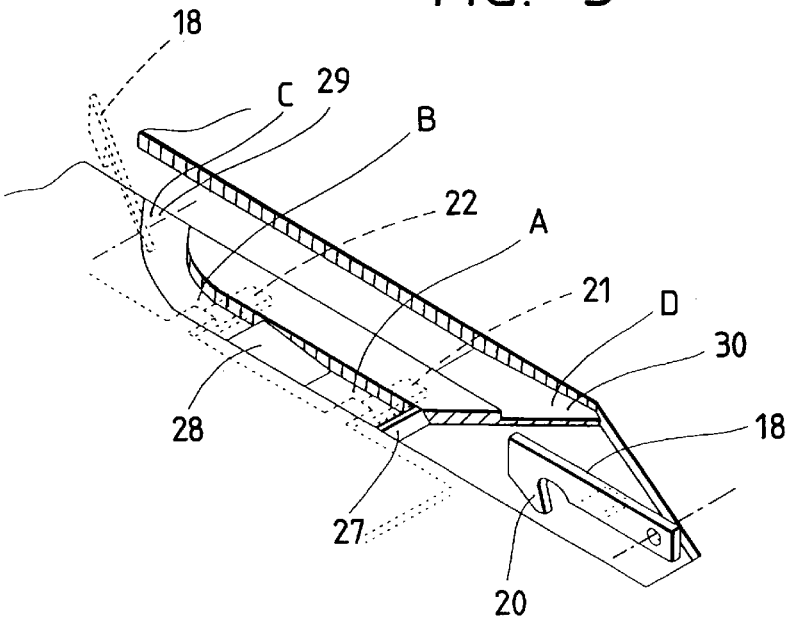
FIG. 3 is a perspective view of the guide means above.
Figure 4:
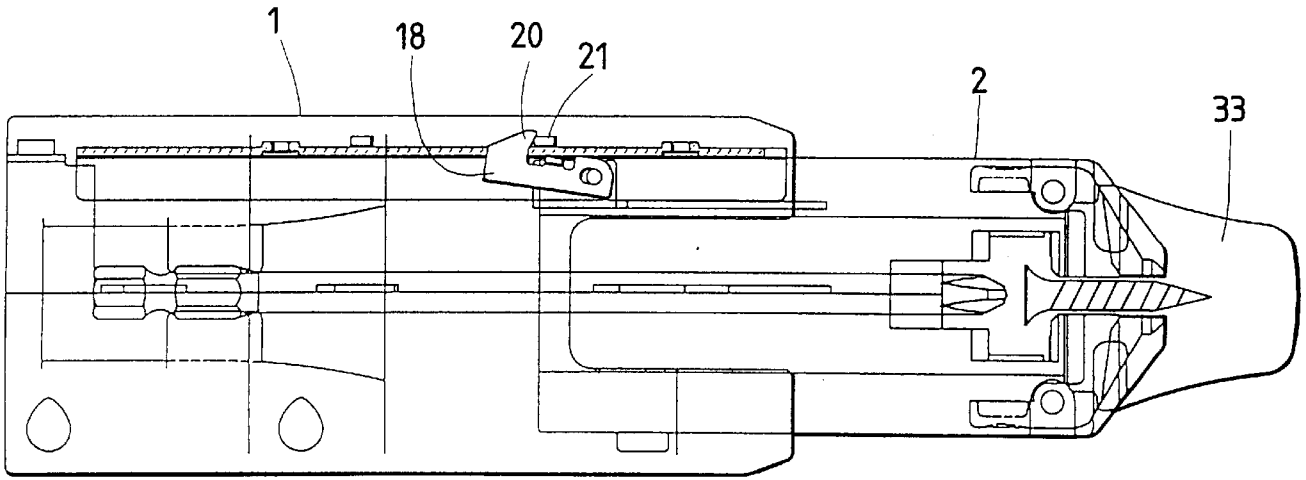
FIG. 4 is a top view of the principal part of the mechanism in operation for preventing two pieces of screws from being simultaneously fed.
Figure 5:
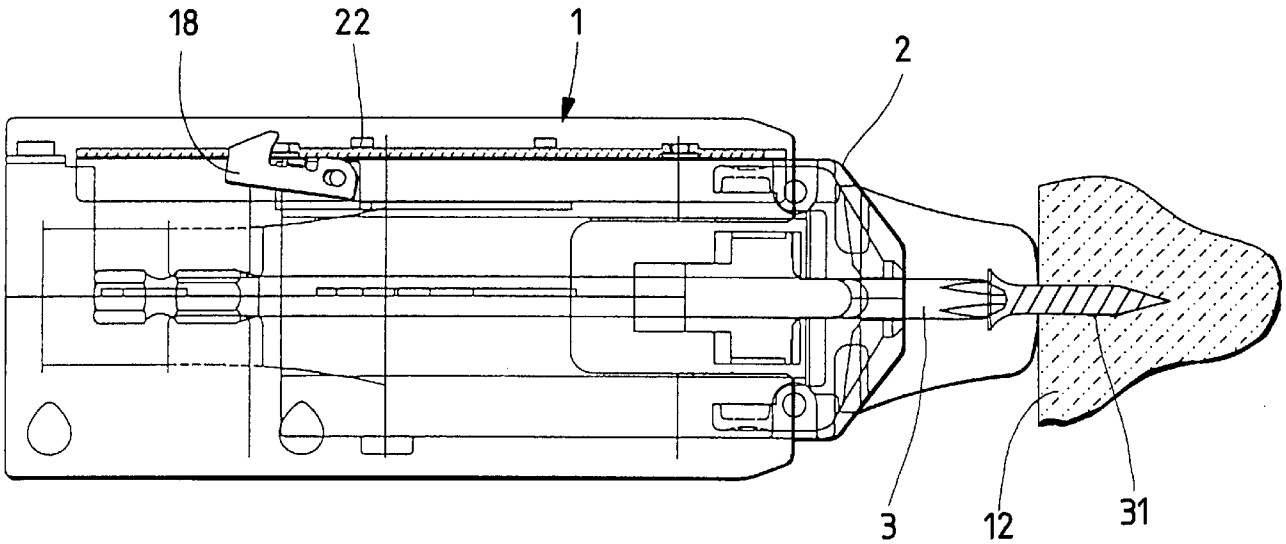
FIG. 5 is a top view of the principal part of the mechanism in operation for preventing two pieces of screws from being simultaneously fed.

When the nose portion 2 is forced into the screw tightener body 1 and moved from the initial position of FIGS. 1(*a*), 1(*b*) to a position A of FIG. 4 (the position of point A of FIGS. 2, 3), the feed wheel 6 has already turned to feed the screw at this point of time. Even though the nose portion 2 is released from being pressed, the retaining pawl 18 is retained by the first retaining member 21, whereby the reset movement of the nose portion 2 is regulated. The screw thus fed is then driven in by pressing the nose portion 2 against the material again.

Even if a screw is thus fed as the nose portion 2 is forced into the screw tightener body 1 by mistake, any inconvenience arising from feeding two pieces of screws according to a minute sign will be obviated since no screw is fed by pressing the nose portion 2 against the material again.

Figure 6:
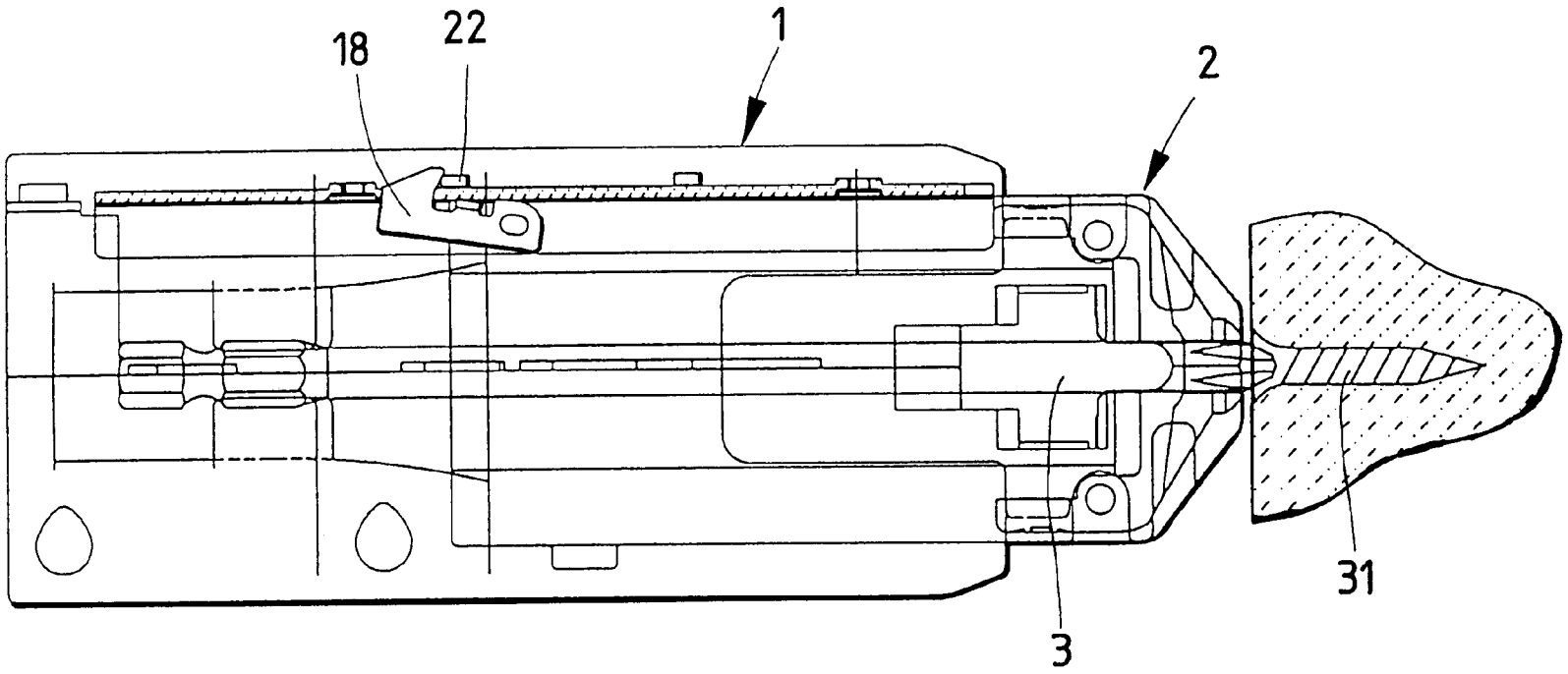
FIG. 6 is a top view of the principal part of the mechanism in operation for preventing two pieces of screws from being simultaneously fed.

When the indentation force is released after the nose portion 2 is moved to be forced into the screw tightener body 1 only by a movement not exceeding to what is equivalent to the predetermined drive-in depth of a screw (the head of a screw 31 is protruded from the material 12 at the position of point B of FIGS. 2, 3) in the course of screw-driving operation, the retaining pawl 18 remains on the first guide groove 25 since it has not crossed the third rising 29, and the retaining pawl 18 is retained by the second retaining member 22 when the nose portion 2 slightly moves back as shown in FIG. 6. Therefore, the reset movement of the nose portion 2 is regulated as in the above case. In this case, the screw can be tightened additionally by screwing the driver bit 3 to the head of the screw 31 thus protruded after a cover 33 is removed from the nose portion 2.

In this way, feeding two pieces of screws is effectively prevented since the nose portion 2 is not moved to be reset even when the nose portion 2 is separated from the material after it is pressed thereagainst to feed the screw. Consequently, the screw thus fed can surely be driven in or tightened again.

When the nose portion 2 is forced into the screw tightener body 1 during the screw-driving operation, the retaining pawl 18 together with the nose portion 2 is guided along the first guide groove 25 of the screw tightener body 1 as shown in FIG. 2. In this case, the retention is smoothly conducted as the retaining pawl 18 is first guided by the first rising 27 immediately before being led to the first retaining member 21, and retained by the first retaining member 21 after it is revolved against the spring force. This is also the case with the retaining pawl 18 to be retained by the second retaining member 22. When the retaining pawl 18 crosses the third rising 29 of the first guide groove 25, it moves to the second guide groove 26.

When the nose portion 2 is moved by the spring 14 to be reset from the screw tightener body 1 after the nose portion 2 is separated from the screw on the termination of the screw-tightening operation, the retaining pawl 18 moves reversely. At the junction of the first guide groove 25, the retaining pawl 18 attempts to move to the first guide groove 25 because of the spring 19. However, the retaining pawl 18 moves along the second guide groove 26 against the force of the spring 19. Then the retaining pawl 18 moves to the first guide groove 25 and returns to the initial position while crossing the fourth rising 30 of the second guide groove 26 when the nose portion 2 is reset to the initial position, whereby the next screw-driving operation is prepared.

The retaining pawl 18 is guided so as to move along the second guide groove 26 when the nose portion 2 is moved to be reset from the screw tightener body 1 after the screw-tightening operation. Consequently, it is avoided for the retaining pawl 18 to be retained by the first or second retaining member 22 at the time the nose portion 2 is moved to be reset.

The retaining pawl as retaining means may be provided for the screw tightener body 1, and the retaining member for the nose portion. In this case, the guide means is provided in the nose portion. Moreover, the guide means for the retaining pawl may be of only such structure as to guide the movement of the retaining pawl and not limited to be in the form of grooves or otherwise protruded channels.

A screw tightener which includes a mechanism for reversely extracting coupled screw according to the present invention will be described below.

Figure 8:
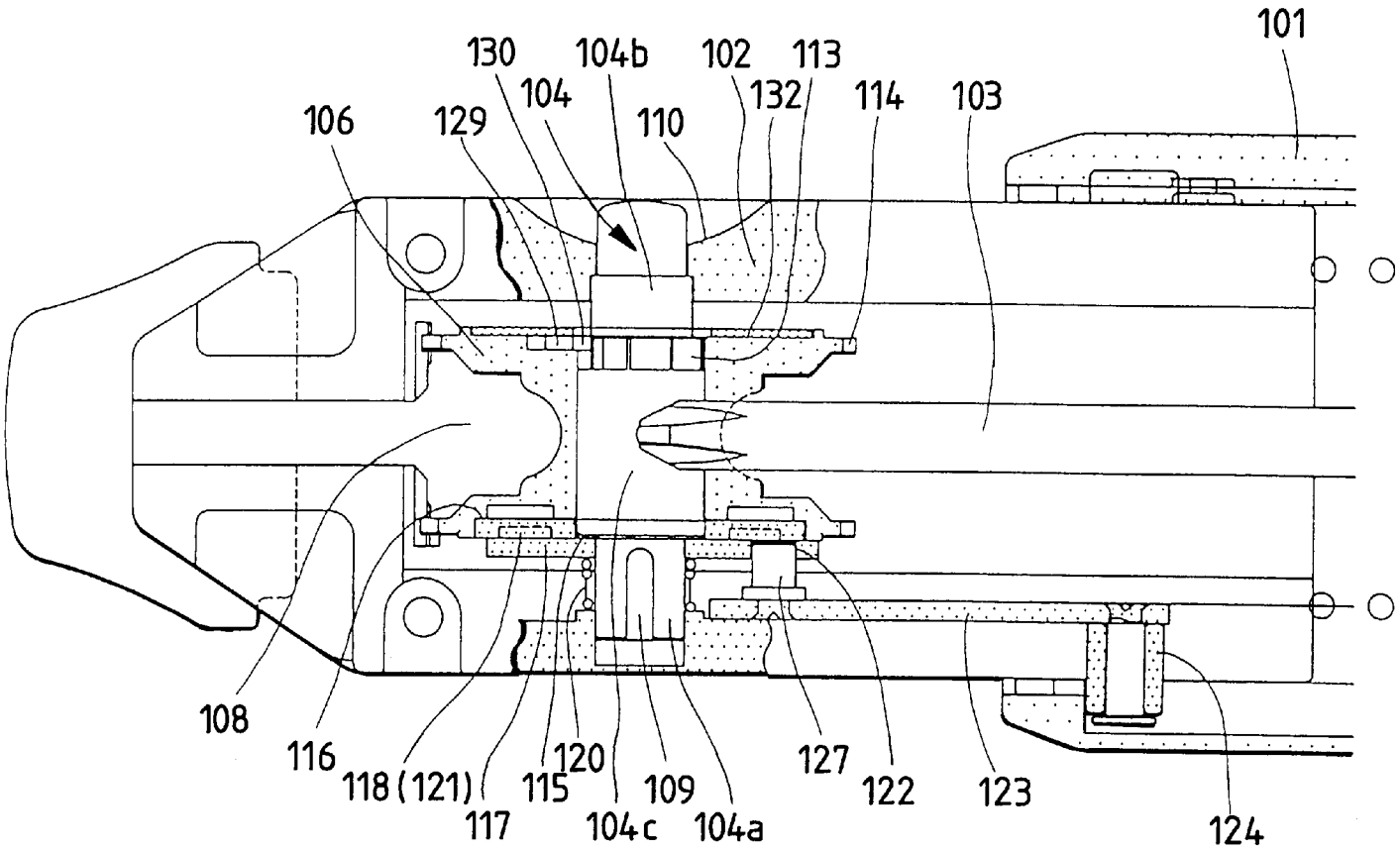
FIG. 8 is a top view of a mechanism for reversely extracting coupled screws in a screw tightener for coupled screws according to the present invention.
Figure 9:
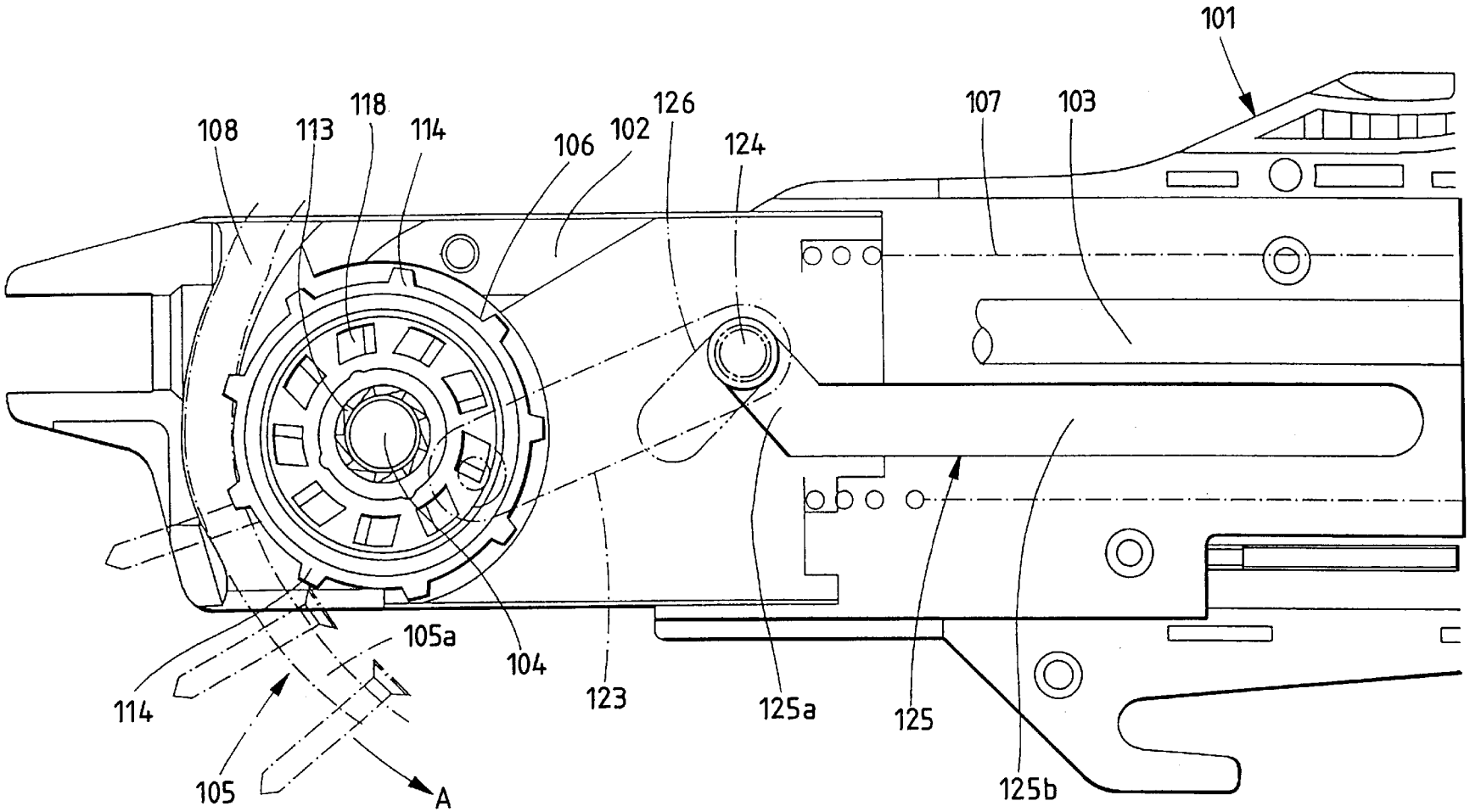
FIG. 9 is a side view of the mechanism for reversely extracting coupled screws in a screw tightener for coupled screws according to the present invention.

FIGS. 8 and 9 show the front portion of a screw tightener, wherein reference numeral 101 denotes a screw tightener body; and 102, a nose portion. The screw tightener body 101 is fitted with a driver bit 103 and a mechanism (not shown) for driving the driver bit 103 to rotate. The nose portion 102 is movable in the axial direction of the driver bit 103, and a feed wheel 106 for feeding coupled screws 105 upward from below is rotatably mounted on a wheel rod 104 supported with both left- and right-hand side parts.

The nose portion 102 is always urged by a spring 107 to move forward, that is, in the direction in which it moves away from the screw tightener body 101. A feed passageway 108 through which the coupled screws 105 are vertically fed is formed through the front part of the nose portion 102, and the coupled screws 105 are inserted into the feed passage 108 upward from below so as to be mounted therein.

Figure 10:
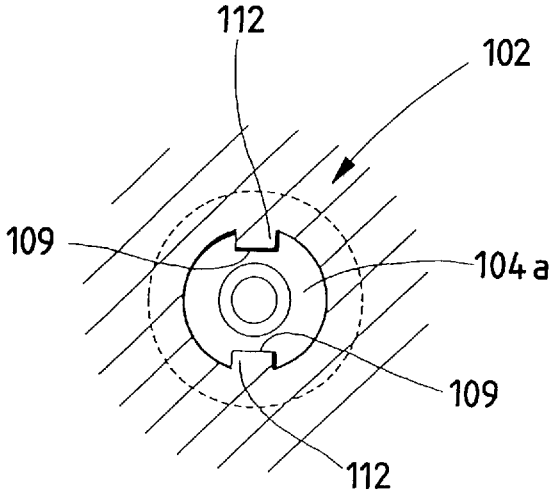
FIG. 10 is a diagram illustrating a mode in which the wheel rod is geared to operational requirements.

The central part of the wheel rod 104 has a large diameter, whereas both end-parts thereof have a small diameter. A keyway 109 is formed at the end of one small-diameter part 104*a* of the wheel rod 104. The other small-diameter part 104*b* of the wheel rod 104 passes through the side of the nose portion 102 and projects from a concave recess 110 formed in its outer side part. As shown in FIG. 10, the end on the side of the keyway 109 is fitted into a bearing 111 on the side part of the nose portion 102, and the keyway 109 mates with a protruded channel 112. Consequently, the wheel rod 104 is made movable in the axial direction, though it is not rotatable. Moreover, a rachet-like pawl 113 is circumferentially and continuously formed on one peripheral face of the large-diameter part 104*c*.

Figure 11:
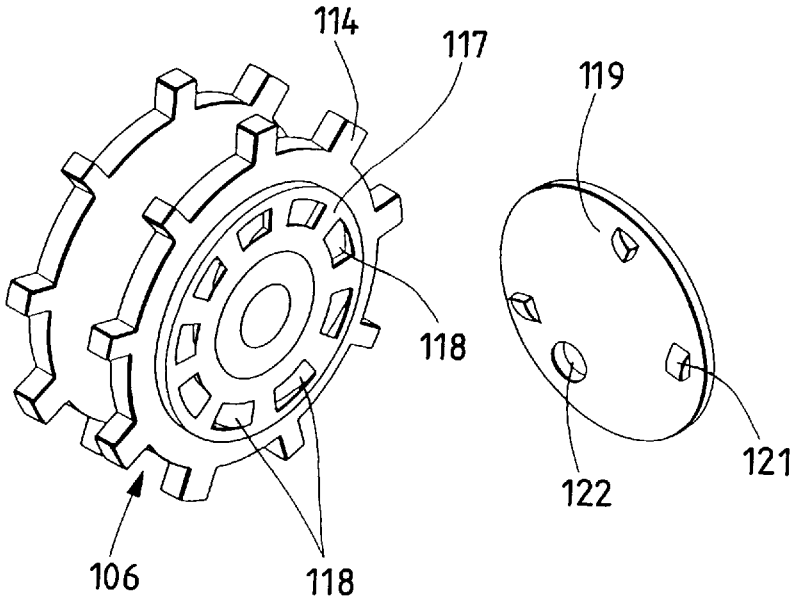
FIG. 11 is a perspective view of the feed wheels.

The feed wheel 106 is rotatably supported by the large-diameter part 104*c* of the wheel rod 104, and mating pawls 114 mating with a coupling belt 105*a* for the coupled screws 105 are formed on the outer peripheral faces on both sides of the feed wheel 106. Moreover, it has been arranged that the side face of the feed wheel 106 and a level-different face 115 between the large and small-diameter parts 104*c*, 104*b* of the wheel rod 104 are on the same plane. Further, a recess 116 is formed in the central part of one side face of the feed wheel 106, and a wheel plate 117 is secured to the recess. As shown in FIG. 11, there are formed nine mating grooves 118 at equal intervals in the outer side face of the wheel plate 117. The mating groove 118 is formed so that one end in the circumferential direction is right-angled and the other end is sloped.

A discoid feed wheel 119 is superposed on one side face of the feed wheel 106. The feed wheel 119 is rotatably supported on the small-diameter part 104*a* at one end of the wheel rod 104, and normally urged by a spring 120 so as to be pressed against the level-different face 115 of the wheel rod 104. Consequently, the feed wheel 119 is also made to move away from the wheel plate 117 by moving the wheel rod 104 in the axial direction against the force of the spring 120.

Figure 12A:
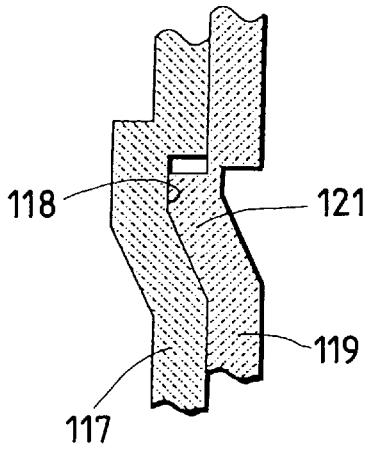
FIGS. 12(*a*) and 12(*b*) show a diagram illustrating a mode in which the mating pawl and the mating groove are engaged and disengaged.
Figure 12B:
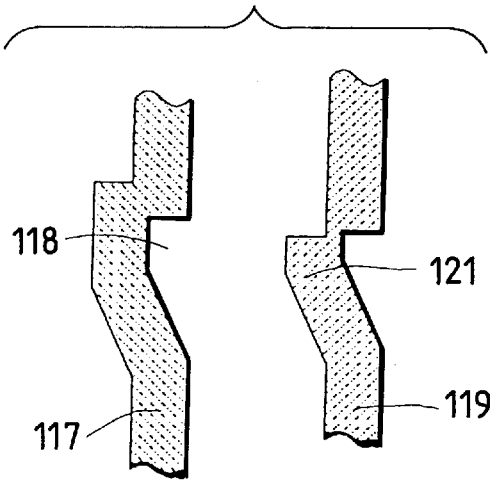

As shown in FIG. 11, moreover, three mating pawls 121 corresponding to the mating grooves 118 of the wheel plate 117 are formed on the inner side face of the feed wheel 119. One circumferential end of the mating pawl 121 is right-angled and the other end is sloped as shown in FIG. 12(*b*). Consequently, the mating pawls 121 mate with the mating grooves 118 of the wheel plate 117 and drive the wheel plate 117 (together with the feed wheel 106) as shown in FIG. 12(*a*) when the feed wheel 119 rotates in the direction in which the coupled screws 105 are fed. When, however, the feed wheel 119 reversely rotates, the mating pawls 21 are released from the mating grooves 118 of the wheel plate 117 as shown in FIG. 12(*b*).

Further, a mating hole 122 is bored in the feed wheel 119, and a feed rod 127 formed at one end of a feed plate 123 fits into the mating hole 122. The feed plate 123 is placed between the screw tightener body 101 and the nose portion 102. A roller 124 is pivotally fitted to the other end of the feed plate 123 and made movable along a first roller guide groove formed in the side part of the screw tightener body 101 and a second groove 126 formed in the side part of the nose portion 102.

Figure 13:
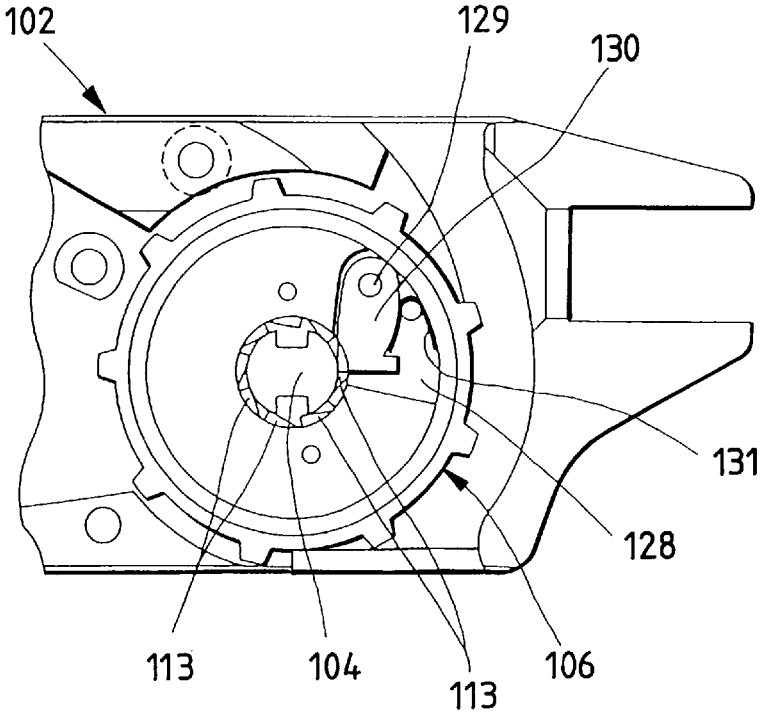
FIG. 13 is a diagram illustrating a mode in which the check pawl is used to prevent reverse rotation.

Subsequently as shown in FIGS. 8 and 13, a recess 128 is formed in the opposite side face of the feed wheel 106, and a support shaft 129 is provided in the recess 128, a check pawl 130 being rotatably fitted to the support shaft 129. The check pawl 130 is placed at a position corresponding to the pawls 113 of the wheel rod 104 and urged by a spring 131 provided in the recess 128 to be retained by the pawls 113 of the wheel rod 104. The check pawl 130 is arranged so that only when the feed wheel 106 rotates in the direction opposite to the direction in which the coupled screws 105 are fed, it is retained by the pawl 113; when the wheel rod 104 is moved in the axial direction, however, the pawl 113 is moved to the position where it does not face the check pawl 130. In this case, a cover plate 132 for pressing down the check pawl 130 is superposed on the side face of the feed wheel 106.

Figure 14:
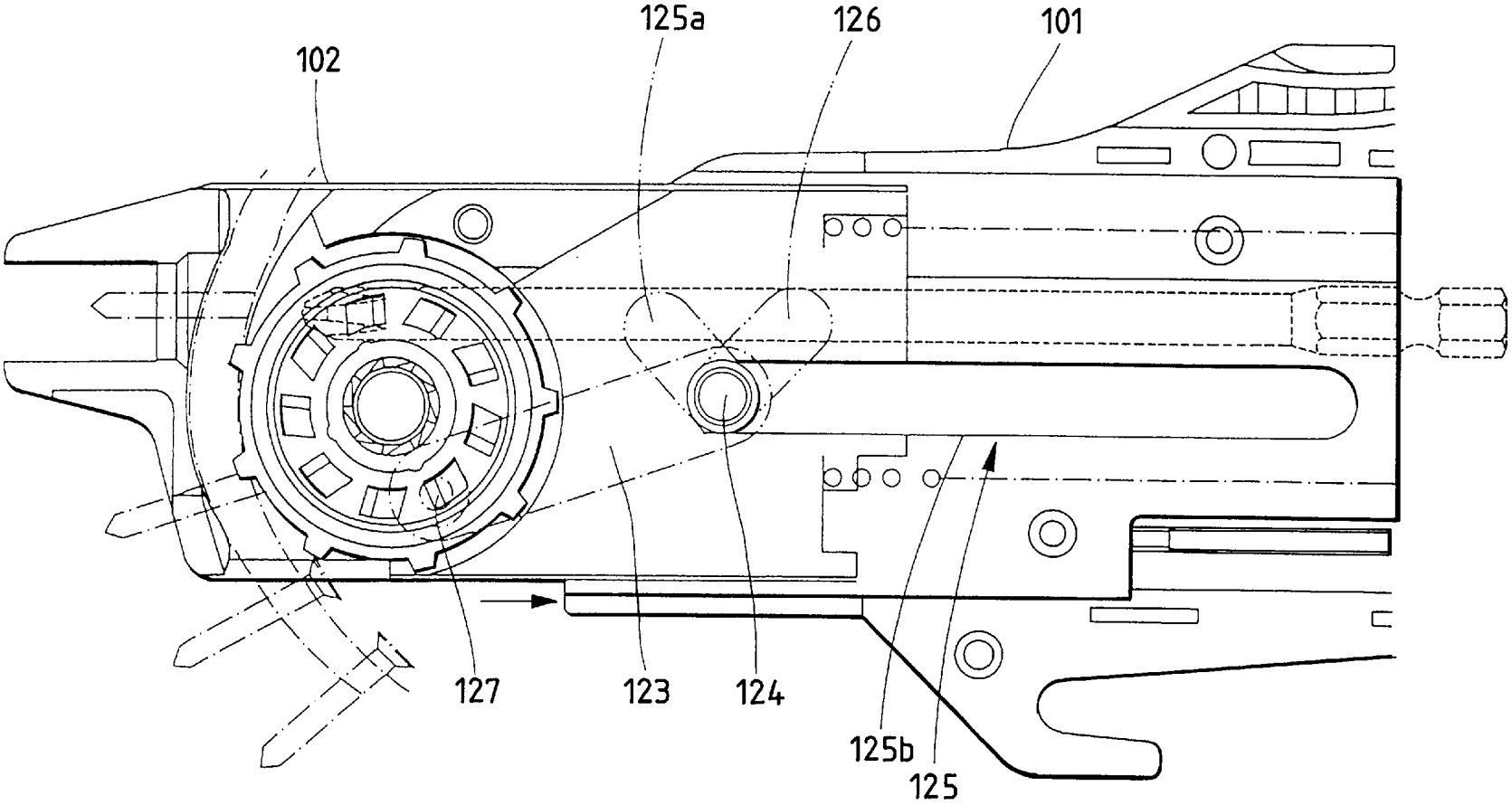
FIG. 14 is a top view illustrating the feeding of the screw.

With the arrangement above, normally the end part 104*b* of the wheel rod 104 is projected from the concave recess 110 formed in the outer side face of the nose portion 102, and the pawl 113 and the check pawl 130 face each other, the mating grooves 118 of the feed wheel 119 being kept mating with the mating pawls 121. When the screw tightener body 101 is pushed forward to press the front end of the nose portion 102 against a material to be screwed down during the screw-tightening operation, the nose portion 102 relatively moves back as shown in FIG. 14 and the movement of the feed plate 123 is interlocked with the relative movement of the nose portion 102 in that the roller 124 at one end of the feed plate 123 is guided along the second roller guide groove 126 of the nose portion 102 and the tilted short groove 125*a* of the first roller guide groove 125 of the screw tightener body 101. As a movement in the moving direction of the feed plate 123 is smaller than the movement of the nose portion 102, the feed rod 27 at the other end of the feed plate 23 presses the feed wheel 119 against the side opposite to the direction in which the nose portion 102 moves in such a state that the feed rod 127 is kept fitting into the mating hole 122 of the feed wheel 119. Consequently, the feed wheel 119 rotates at a constant angle of rotation in the direction in which the coupled screws 105 are fed. As the mating groove 118 of the feed wheel 119 has mated with the mating pawl 121 of the wheel plate 117, the wheel plate 117 also rotates only by the same quantity of rotation, whereby the feed wheel 106 simultaneously rotates by an angle of rotation corresponding to the feeding of one out of the coupled screws 105 in the feeding direction. When the screw tightener body 101 is pushed forward further, the driver bit 103 mates with the screw thus fed and while rotating the screw, the driver bit 103 drives it into the material. Then the roller 124 of the feed plate 123 moves along the long groove part 125*b* of the roller guide groove.

When the screw tightener is separated from the screw on the termination of the screw-driving operation, the spring 107 allows the nose portion 102 to return to the original reset position, and the roller 124 of the feed plate 123 is finally moved while guided along the second roller guide groove 126 of the nose portion 102 and the tilted short groove 125*a* of the first roller guide groove 125 of the screw tightener body 101. Since the movement of the roller 124 is smaller than that of the nose portion 102 in its moving direction, however, the feed rod 127 of the feed plate 123 is, as shown in FIGS. 8 and 9, moved in the opposite direction this time, so that the feed wheel 119 reversely rotates in the direction opposite to the screw-feeding direction. On the other hand, the check pawl 130 is kept being retained by the pawl 113 of the wheel rod 104 and consequently the feed wheel 106 as well as the wheel plate 117 does not rotate reversely. The next screw-feeding is thus prepared.

In accordance with the screw-tightening operation in which the nose portion 102 is forced into the screw tightener body and put back, the feed wheel 106 intermittently revolves in the direction in which the coupled screws 105 are fed so as to feed the coupled screws 105 successively to the nose portion 102 one after another.

Figure 15:
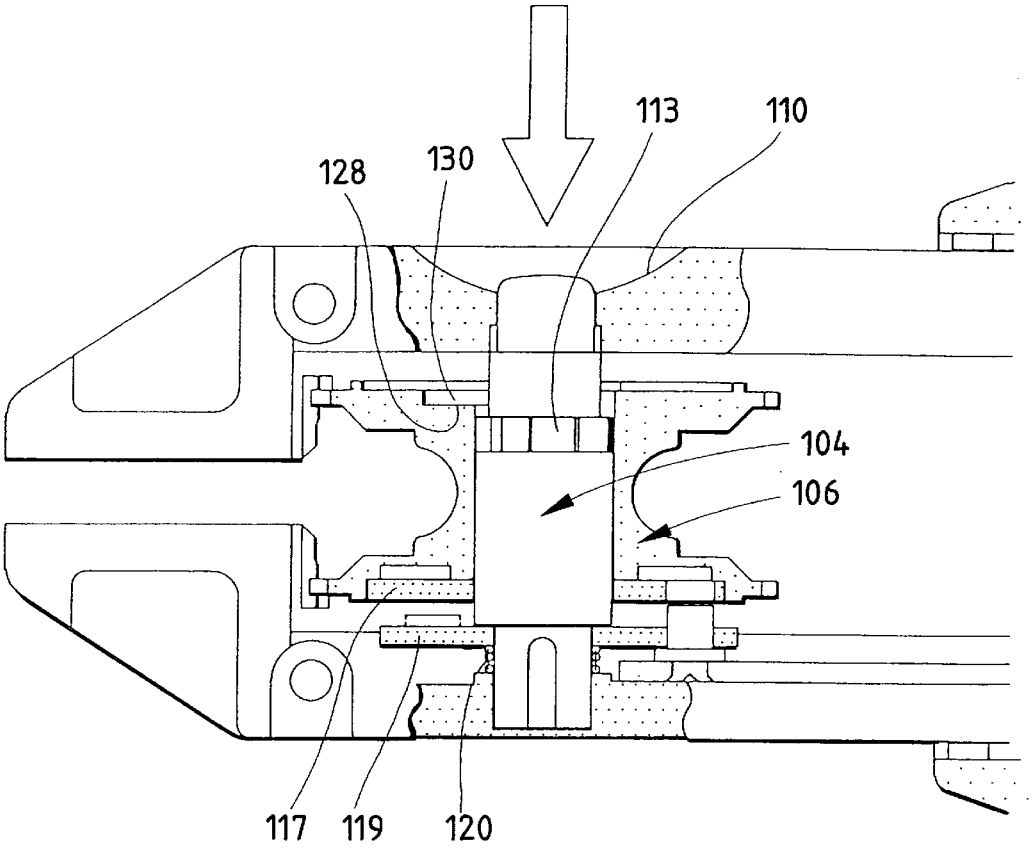
FIG. 15 is a side view at the time the mechanism for reversely extracting coupled screws is operated.

In a case where the screw 105 that has been mounted once is extracted, the wheel rod 104 projected from the concave recess 110 is axially pushed against the force of the spring 120 as shown in FIG. 15. The pawl 113 then moves to the position where it does not face the check pawl 130, and the feed wheel 119 together with the wheel rod 104 simultaneously moves back to the position where it does not mate with the wheel plate 117 of the feed wheel 106. Thus the feed wheel 106 is set free from rotating in the feeding direction and what is opposite thereto. While the feed wheel 106 is kept rotating reversely, the screw 105 can be extracted in the direction opposite to the direction in which the coupled screws 105 are mounted therein (in the direction shown by an arrow A of FIG. 8).

When the indentation force applied to the wheel rod 104 is released, the resilient force of the spring 120 causes the wheel rod 104 to return to the original position, thus making the pawl 113 face the check pawl 130. At the same time, the mating pawls 121 of the feed wheel 119 are reset to the position where they can mate with the respective grooves 118 of the wheel plate 117.

According to the present invention, the rotation of the feed wheel is set free only by axially pushing the wheel rod so as to extract a screw reversely. The operation can thus be simplified.

While the pawls and the mating pawls are moved together with the wheel rod, the check pawl and the mating grooves formed on the feed wheel side makes it possible to engage and disengage the pawls and the check pawl, and to engage and disengage the mating grooves and mating pawls simultaneously only by moving the wheel rod in the axial direction. This mechanism simple in construction therefore contributes to decreasing the number of parts and implementing an attempt to reduce the manufacturing cost.

Since the end part of the wheel rod has been devised to project from the concave recess in the outer side of the nose portion, it can be arranged without projecting from the side face of the nose portion. It is therefore possible to prevent effectively an unexpected accident resulting from allowing the wheel rod to bump against a material to be screwed down and so forth during the screw-tightening operation.

Moreover, the whole design will not be impaired as the end part of the wheel rod is only to project from the concave recess and therefore unobtrusive.

Figure 20:
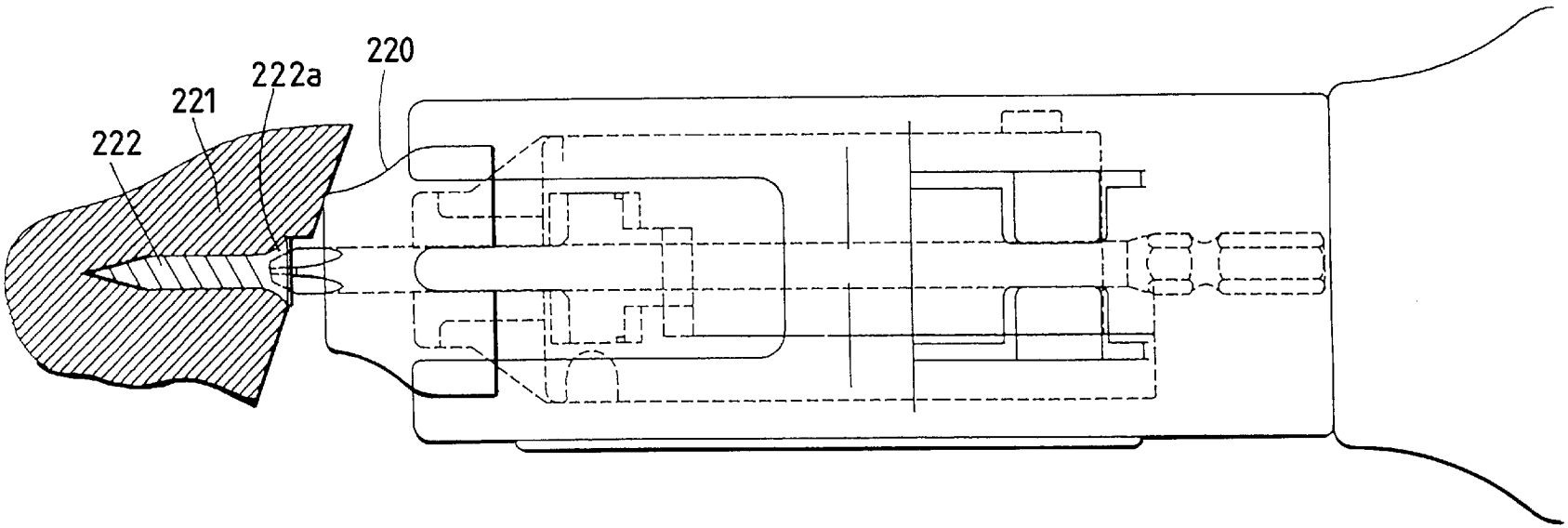
FIG. 20 is a diagram illustrating a mode in which a screw is driven in a slanted material.

FIG. 20 shows to employ a screw tightener for tightening a screw 222 in a face material 221 having a slanted surface.

As shown in FIG. 20, part of a protective cover 220 is consequently caused to abut against the surface of the face material 221, and the screw tends to become turned insufficiently because of the large diameter of the screw 222. Hence, there often arises nonconformity in that while one side of a screw head 222*a* sinks below the surface of the face material 221, the other side protrudes therefrom. In actual operation, the frequency of driving screws slantwise is extremely high and besides cloth is usually stretched on the face material 221 to finish the work. The screw head 222*a* protruding from the surface of the face material 221 results in poor surface finish, which makes it necessary to tighten the screw 222 again, and this adds complication to the screw-driving operation.

A protective cover at the tip of a screw tightener as is capable of tightening screws so as to prevent the protrusion of screw heads from a face material even when the screws are driven into the material slantwise is designated.

The protective cover applied to a screw tightener according to the embodiments of the invention described below.

Figure 16:
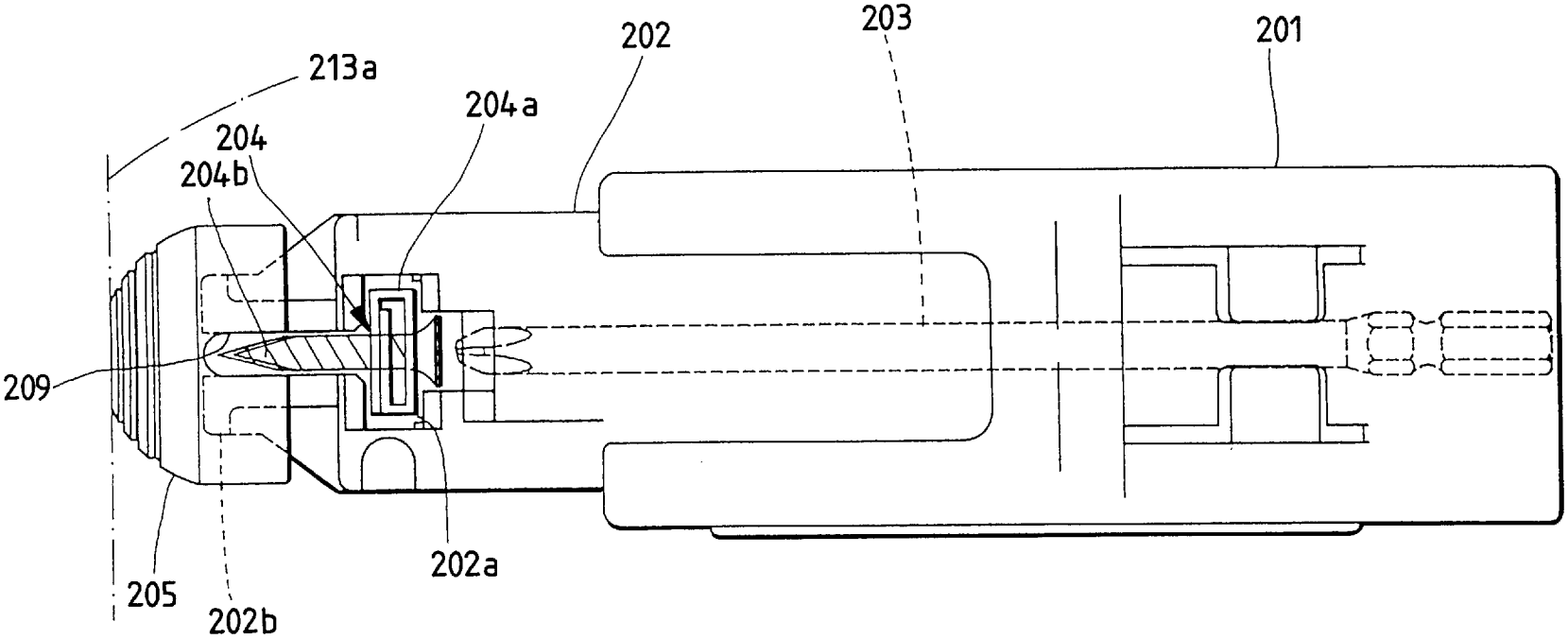
FIG. 16 is a top view of a screw tightener according to the present invention.

In FIG. 16, reference numeral 201 denotes a screw tightener body; 202, a nose portion at the leading end of the screw tightener body 201; and 203, a driver bit. The screw tightener body 1, the nose portion 202 and the driver bit may be provided according to the embodiments described above.

Figure 18A:
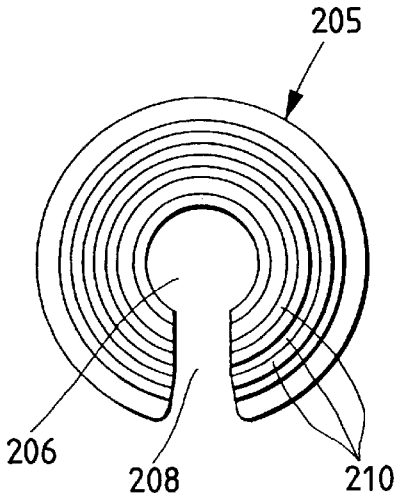
FIGS. 18(*a*), 18(*b*) and 18(*c*) is respectively, an elevational, a top and a rear elevational view of a protective cover of the screw tightener.
Figure 18B:
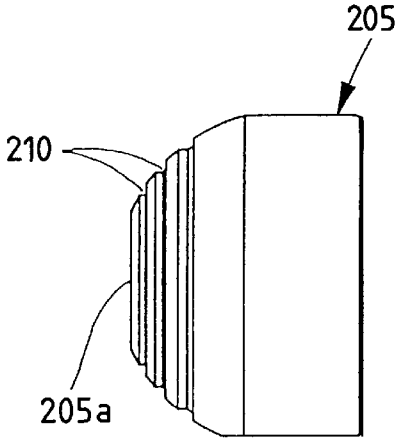
Figure 18C:
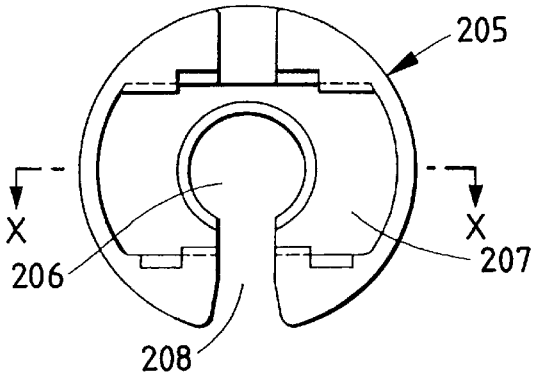

A protective cover 205 is made of urethane resin and mounted at the front end of the nose portion 202. As shown in FIGS. 18(*a*), 18(*b*), 18(*c*) and FIG. 19, a hole 206 for passing a screw and the driver bit 203 is made in the center of the protective cover 205. Further, the protective cover 205 has a rear opening, and a recessed portion 207 therein which mates with the front end part 202*b* of the nose portion 202. A grooved opening 208 communicating with the hole 206 is formed in the lower part of the protective cover 205, whereas a grooved opening 209 is also formed on the upper base end side of the protective cover 205.

The front (tip) of the protective cover 205 has a spherical surface, which includes a non-slip arrangement in the form of a plurality of concentric circular grooved channels 210 around the top part 205*a* of the spherical surface. Both sidewalls 211 of the grooved channel 210 for the non-slip arrangement are formed so that they are parallel to the axis of the protective cover 205.

The protective cover 205 is mounted by fitting the front part 202*b* of the nose portion 2 into the recessed portion 207. At this time, the axis of the driver bit 203 to extend conforms to the center of the hole 206 of the protective cover 205.

The coupled screws 204 are prepared by coupling a number of screws 204*b* to a coupling belt 204*a* of synthetic resin or the like, and the coupled screw 204 is mounted so as to pass through the grooved through-hole 202*a* of the nose portion 202 upward from below. Then the forefront screw 204*b* is set so that it stays on the extended center axis of the driver bit 203 of the screw tightener body 201 and faces the hole 206 of the protective cover 205.

When the coupled screws 204 are mounted, the forefront screw 204*b* is passed through the grooved opening 208 on the lower side of the protective cover 5 before being set in position. In case the forefront screw 204*b* has been driven in unsatisfactorily, it will be discharged from the protective cover 205 through its upper grooved opening 209.

When the screw tightener thus constructed is used, the front of the protective cover 205 in the nose portion 202 is pressed against a face material 213*a* to push the nose portion 202 in. While rotating relatively, the driver bit 203 of the screw tightener body 201 moves forward and pushes out the screw 4*b* in the nose portion 202. The rotating screw 204*b* is then forced out and driven into the face material 213*a*. When the screw tightener is separated from the face material 213*a* after the screw-tightening operation is completed, the nose portion 202 is also separated from the screw tightener, and the driver bit 203 retracts. The relative movement of the nose portion 202 causes the screw feeding mechanism to operate, thus effecting the feeding of the coupled screws 204.

Figure 17:
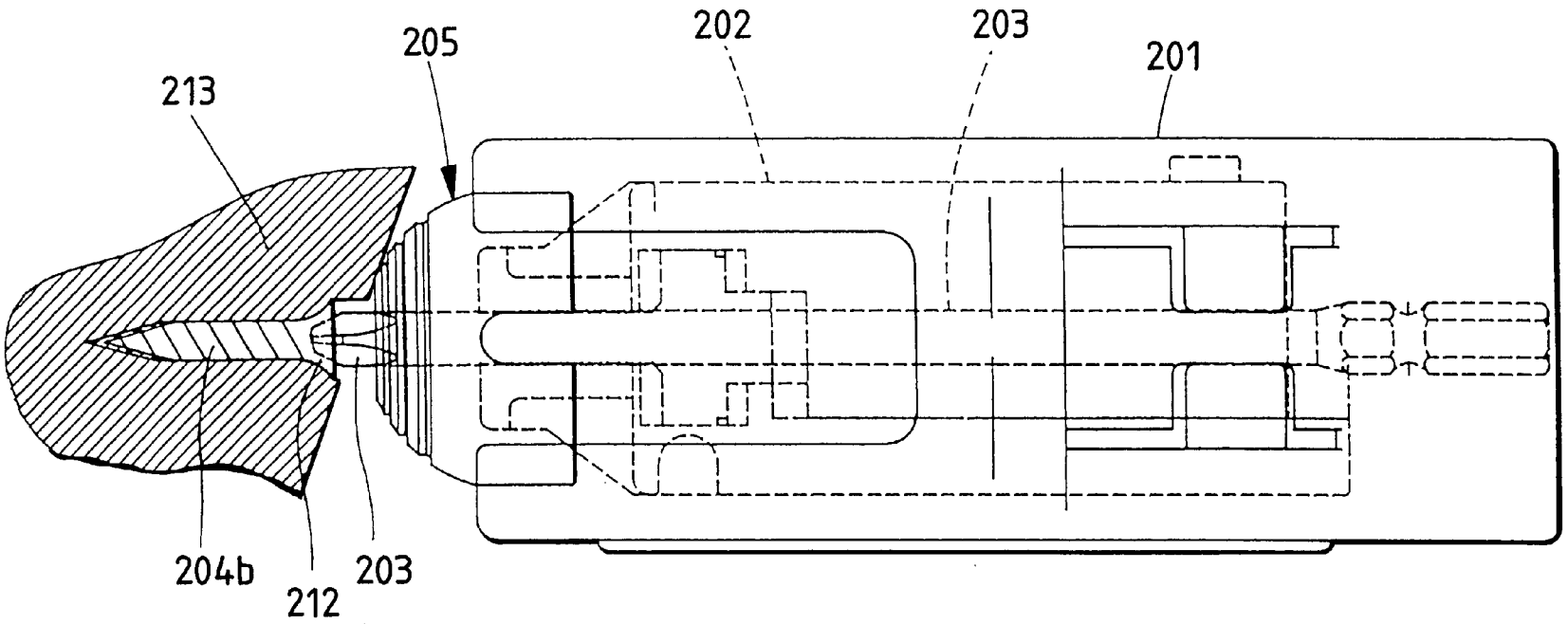
FIG. 17 is a diagram illustrating a mode in which a screw is driven in by the screw tightener according to the present invention.

In a case where a screw is driven into a face material 213 slantwise, screw-driving operation is carried out likewise. Since the screw tightener is tilted as shown in FIG. 17 in this case, the region deflected from the center of the protective cover 205 toward the tilted side is pressed against the face material 213. The spherical surface at the front of the protective cover 205 is not separated much from the face material 213 even when the screw tightener is tilted. Therefore, the screw 204*b* is sufficiently deeply driven into the face material 213 as shown in FIG. 17 and its head 212 is never protruded from the surface of the face material 213. The operation of additionally tightening the screw can thus be dispensed with.

Moreover, the non-slip arrangement on the outer face of the protective cover 205 prevents the protective cover 205 from slipping off the screw-driving position when the screw tightener is pressed against the face material 213 slantwise to ensure that owing to the absence of such nonconformity as slipping off the screw-driving position, reliable screw-driving work is carried out at all times.

Figure 19:
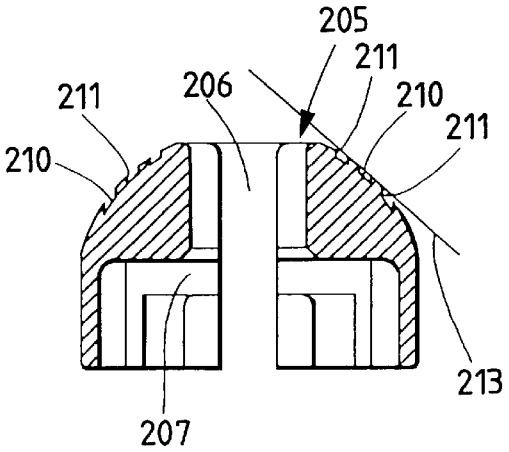
FIG. 19 is an enlarged sectional view taken on line X—X of FIG. 18(*c*)

Since both sidewalls of the grooved channel 210 for the non-slip arrangement are set parallel to the axis of the protective cover 205, one sidewall 211 of the grooved channel 210 abuts against the face material 213 at an acute angle as shown in FIG. 19. Consequently, resistance originating from the edge increases and this strengthens the non-slip effect further.

Incidentally, the grooved channels constituting the non-slip arrangement need not necessarily be concentric but may be formed spirally from the top part of the spherical surface of the protective cover.

In place of the aforementioned grooved channels, protruded channels may be formed on the outer face of the protective cover.

What is claimed is:

1. A screw tightener using coupled screws comprising:

a screw tightener body including a driver bit;

a nose portion movable in an axial direction of said driver bit;

a spring for urging said nose portion to move forward from said screw tightener body;

a feed wheel rotatably supported by said nose portion, wherein coupled screws supplied to said nose portion are fed in a direction of extension of said driver bit by interlocking rotation of said feed wheel with movement of said nose portion into said screw tightener body;

retaining means for mutually retaining said screw tightener body and said nose portion when an indentation force is released after said nose portion is moved partway into said screw tightener body, said retaining means including:

a pawl provided on said nose portion, a first guide groove formed on said screw tightener body, a first retaining member provided on said first guide groove for preventing said pawl from moving reversely, and a second retaining member provided on said first guide groove downstream of said first retaining member for preventing said pawl from moving reversely; and guide means for preventing said retaining means from retaining when said nose portion is caused by said spring to make a reset movement with respect to said screw tightener body after said nose portion is moved into the screw tightener body by a predetermined movement, said guide means including, a second guide groove formed on said screw tightener such that said first guide groove and said second guide groove are continuous in the form of a loop.

2. A screw tightener according to claim 1, wherein retaining position of said retaining means is a position to which the nose portion is moved and at which the nose portion is forced into said screw tightener body by a feed of one screw.

3. A screw tightener according to claim 1, wherein retaining position of said retaining means is a position to which the nose portion is moved and at which the nose portion is forced into the screw tightener body by a movement not exceeding what is equivalent to predetermined drive-in depth of a screw.

4. A screw tightener using coupled screws comprising:

a screw tightener body including a driver bit;

a nose portion movable in an axial direction of said driver bit at a leading end of said screw tightener body fitted with said driver bit, said nose portion has a concave recess on an outer side thereof;

a wheel rod fitted to said nose portion so as to be movable in an axial direction of said wheel rod;

a coupled-screw feed wheel rotatably supported by said wheel rod;

a feed wheel which is installed on one side of said coupled-screw feed wheel an coaxially superposed on said coupled-screw feed wheel only when said coupled-screw feed wheel rotates in a direction in which the coupled screws are fed in a state interlocked with a relative movement of said screw tightener and said nose portion; and a check pawl which is installed on an other side of said coupled-screw feed wheel and capable of retain one of a plurality of continuously-formed pawls on an outer peripheral face of said wheel rod only when said coupled-screw feed wheel rotates in a direction opposite to the direction in which the coupled screws are fed, wherein said wheel rod having one end arranged so as to normally protrude from said concave recess to make the continuously-formed pawls and the check pawl face each other, is placed at a position where said feed wheel is allowed to mate with said coupled-screw feed wheel, and the one of said continuously-formed pawls is shifted to a position where it will not correspond to the check pawl by pushing the one end of said wheel rod in the axial direction of said wheel rod, so that said feed wheel is moved to a position where said feed wheel and said coupled-screw feed wheel are not allowed to mate with each other.

5. A screw tightener according to claim 4, wherein said wheel rod has a length so as not to project from a said face of said nose portion.

* * * * *